US011492937B2

(12) United States Patent
Mendoza Bravo et al.

(10) Patent No.: US 11,492,937 B2
(45) Date of Patent: Nov. 8, 2022

(54) MULTI-MODE EXHAUST MUFFLER

(71) Applicant: Ford Global Technologies, LLC, Dearborn, MI (US)

(72) Inventors: Omar Yuren Mendoza Bravo, Cuautitlan Izcalli (MX); Kenneth Michael Sedore, Dundee, MI (US); Raymond Morelli, Jr., Perrysburg, OH (US)

(73) Assignee: Ford Global Technologies, LLC, Dearborn, MI (US)

( * ) Notice: Subject to any disclaimer, the term of this patent is extended or adjusted under 35 U.S.C. 154(b) by 264 days.

(21) Appl. No.: 16/685,593

(22) Filed: Nov. 15, 2019

(65) Prior Publication Data

US 2021/0148262 A1 May 20, 2021

(51) Int. Cl.
*F01N 1/18* (2006.01)
*F01N 1/02* (2006.01)
(Continued)

(52) U.S. Cl.
CPC ..... *F01N 1/18* (2013.01); *F01N 1/026* (2013.01); *F01N 1/165* (2013.01);
(Continued)

(58) Field of Classification Search
CPC . F01N 1/18; F01N 1/026; F01N 1/165; F01N 1/16; F01N 1/161; F01N 1/166; F01N 1/168; F01N 2470/02; F01N 2470/14; F01N 2470/16; F01N 1/08; F01N 1/083; F01N 1/084
See application file for complete search history.

(56) References Cited

U.S. PATENT DOCUMENTS 2,479,165 A 8/1949 Jackson
3,620,330 A 11/1971 Hall
(Continued)

FOREIGN PATENT DOCUMENTS

CN 108779692 A * 11/2018 ..... F01N 1/089
DE 10104293 A1 * 3/2002 ..... F01N 1/08
(Continued)

OTHER PUBLICATIONS

Drummond, M., "Active Exhaust Modes," CJ Pony Parts Website, Available Online at https://www.cjponyparts.com/resources/active-exhaust-modes, Oct. 15, 2019, 11 pages.

*Primary Examiner* — Edgardo San Martin
(74) *Attorney, Agent, or Firm* — Vincent Mastrogiacomo; McCoy Russell LLP

(57) ABSTRACT

A multi-mode muffler for an exhaust system of an internal combustion engine provides a rotary plate that modulates exhaust gas flow between a first and second flow path. Each flow path may provide different sound dampening characteristics, thereby providing different sound profiles with the same muffler. In a disclosed embodiment, the rotary plate is driven by a shaft coupled to an external actuator. Also, a third possible position of the rotary plate may allow flow through both the first and second flow paths, thereby providing a third possible noise profile. One of the sound profiles may be louder than the other thereby allowing the muffler to switch between "loud" and "quiet" modes of operation.

19 Claims, 11 Drawing Sheets

(51) Int. Cl.
*F01N 1/08* (2006.01)
*F01N 1/16* (2006.01)

(52) U.S. Cl.
CPC ..... *F01N 2470/02* (2013.01); *F01N 2470/14* (2013.01); *F01N 2470/16* (2013.01)

(56) References Cited

U.S. PATENT DOCUMENTS 4,715,472 A * 12/1987 McKee ..... F01N 1/165 181/239
5,743,088 A * 4/1998 Grath ..... F01N 13/087 181/236
5,930,371 A * 7/1999 Cheng ..... F01N 1/023 381/71.5
6,160,892 A 12/2000 Ver
6,367,580 B1 * 4/2002 Chang ..... F01N 1/08 181/219
6,499,562 B1 12/2002 Elfinger et al.
6,612,400 B2 9/2003 Bravo
6,901,752 B2 * 6/2005 Uhler ..... F01N 1/08 60/312
7,055,484 B2 * 6/2006 Marks ..... F02B 27/0294 123/184.57
7,337,609 B2 * 3/2008 Mahnken ..... F01N 1/165 181/237
7,510,051 B2 3/2009 Schrandt
7,913,810 B2 3/2011 Meneely et al.
9,728,177 B2 * 8/2017 Mekid ..... G10K 11/002
10,082,058 B2 * 9/2018 Creager ..... F01N 1/24
2008/0023264 A1 1/2008 Pacini et al.
2008/0314679 A1 12/2008 Rowe et al.
2010/0170743 A1 7/2010 Meneely et al.
2011/0303864 A1 12/2011 Lee
2021/0140354 A1 * 5/2021 Yang ..... F01N 1/006

FOREIGN PATENT DOCUMENTS

DE 10111369 A1 * 9/2002 ..... F01N 1/006
DE 10155311 A1 * 5/2003 ..... F01N 1/166
DE 10354699 A1 * 6/2005 ..... F01N 13/011
DE 102010008742 A1 * 8/2011 ..... F01N 1/166
DE 102012020420 A1 * 4/2014 ..... F01N 1/18
JP 2001003726 A * 1/2001
KR 20070064525 A * 6/2007
KR 20160063596 A * 6/2016
WO WO-2005026508 A1 * 3/2005 ..... F01N 1/003

* cited by examiner

Explosive view

Assembly view

MULTI-MODE EXHAUST MUFFLER

FIELD

The present description relates generally to an exhaust muffler in an exhaust system of an internal combustion engine that provides different sound tuning modes of operation based on predetermined criteria.

BACKGROUND/SUMMARY

Some customers prefer that their vehicle emit different ambient sound profiles depending on their environment in which they operate. For example, it may be desirable for a vehicle to operate as quietly as possible during day-to-day operations, but provide more powerful and louder sounding engine noise when the vehicle operates for recreational purposes or is on display.

Exhaust mufflers allow exhaust noise generated from an internal combustion engine or the like to be tuned to provide a particular sound profile. Efforts have been made to vary the exhaust flow through the muffler to provide different sound profiles. For example, U.S. Pat. No. 7,510,051 discloses a muffler system in which a butterfly valve is actuatable between an open and closed positon directing exhaust flow between differing flow paths, each flow path providing a different noise attenuation characteristic. Similarly, published U.S. patent application US20080314679, now abandoned, discloses a muffler system that aligns two perforated pipes with respect to each other so that holes and other shapes align to vary the exhaust flow through the muffle. The pipes slide with respect to each other to allow the muffler to be tuned. These types of systems tend to rely on a plurality of actuators, particularly in dual exhaust systems. Moreover, they tend to be complex structures that can be prone to premature fatigue, and they tend to limit the type and quality of sound attenuation provided.

The inventors have recognized the aforementioned problems and facing these problems developed a multi-mode exhaust muffler that provides at least two different sound attenuation profiles using a single actuator while providing substantially the same complexity and durability of internal parts as a single mode muffler. In a disclosed embodiment, the muffler has an internal mechanism that varies the geometry of apertures relative to sound attenuation devices to provide different exhaust gas flow paths through the apertures and sound attenuation devices, thereby providing more than one possible sound profile for the muffler.

In one example, the internal mechanism is a rotary plate having spaced apart openings therethrough and positioned between a fixed plate and an end plate. The rotating plate is pivotally secured to a shaft that is operably secured to an actuator. The actuator turns the plate on its axis to align different apertures with different sound attenuation devices, thereby regulating which sound attenuation devices receive exhaust flow and allowing the noise characteristics to change based on the position of the rotating plate relative to the fixed plate. In a preferred embodiment, the rotating plate has two different positions relative to the fix plate; a first position wherein exhaust flow is directed through noise attenuation devices that muffle sound; and a second position wherein exhaust flow is directed through noise attenuation devices that muffle less sound. A third position may also be provided as the plate moves between the first and second positon providing a transition sound profile.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The following description relates to a multi-mode muffler for an exhaust system of an internal combustion engine. The muffler has an internal mechanism that varies the geometry of apertures relative to sound attenuation devices to provide different exhaust gas flow paths through the apertures and sound attenuation devices, thereby providing more than one possible sound profile for the muffler.

In one example, the internal mechanism is a rotary plate having spaced apart openings there through and positioned between a fixed plate and an end plate. The rotating plate is pivotally secured to a shaft that is operably secured to an actuator. The actuator turns the plate on its axis to align different apertures with different sound attenuation devices, thereby regulating which sound attenuation devices receive exhaust flow and allowing the noise characteristics to change based on the position of the rotating plate relative to the fixed plate.

Figure 1:
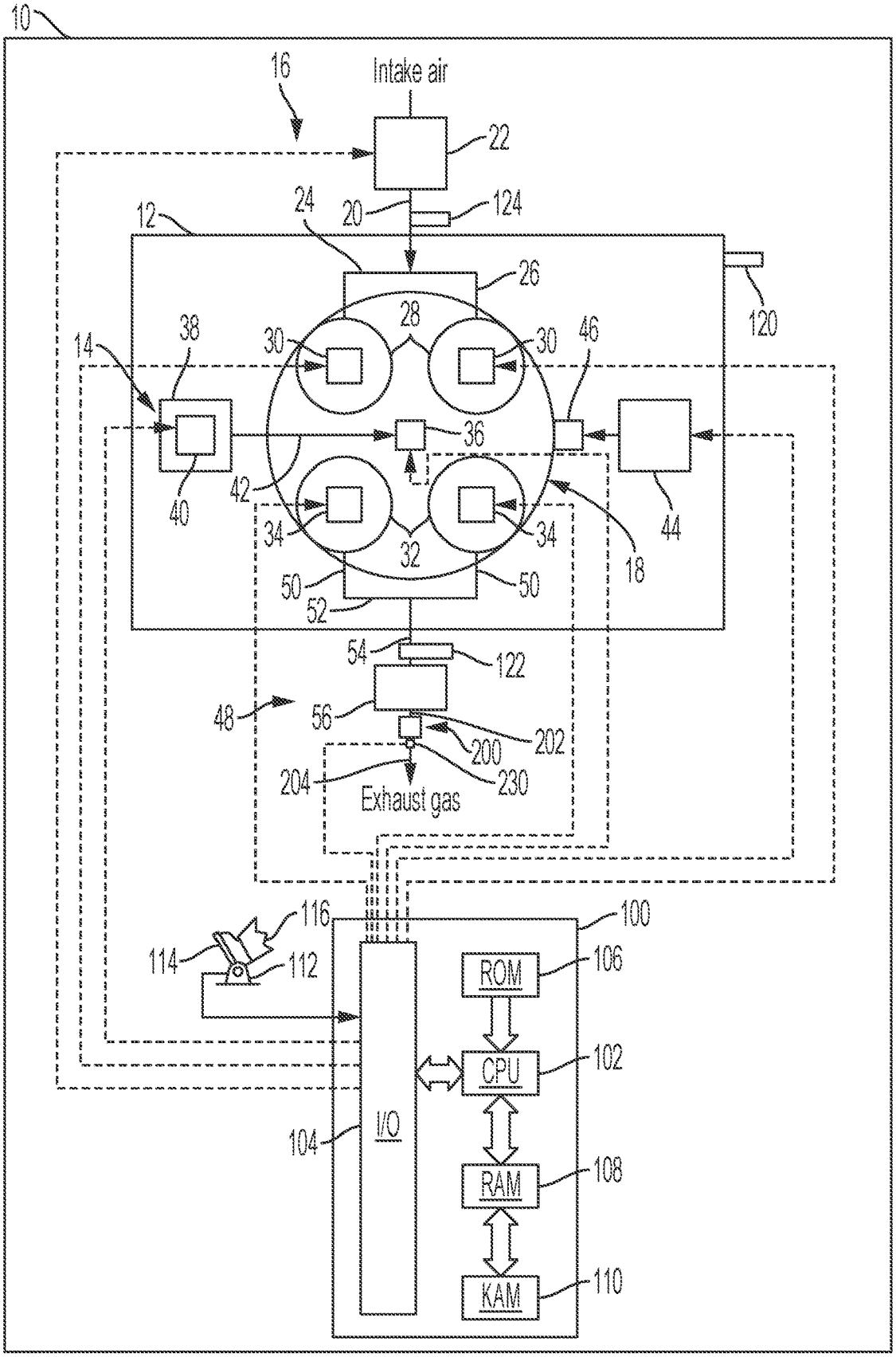
FIG. 1 shows a schematic depiction of an internal combustion engine having a multi-mode exhaust muffler in accordance with an embodiment of this invention.

FIG. 1 shows a schematic depiction of a vehicle with an internal combustion engine including an exhaust system 48 having a multi-mode exhaust muffler 200. FIGS. 2-15 show internal features and operation of the multi-mode exhaust muffler 200.

Turning to FIG. 1, a vehicle 10 having an engine 12 with an exhaust system 48 having a muffler 200 is schematically illustrated. Although, FIG. 1 provides a schematic depiction of various engine and other operational components, it will be appreciated that at least some of the components may have a different spatial positions and greater structural complexity than the components shown in FIG. 1. The structural details of the exhaust components are discussed in greater detail herein with regard to FIGS. 2-13.

An intake system 16 providing intake air to a cylinder 18 is also depicted in FIG. 1. Although, FIG. 1 depicts the engine 12 with one cylinder, the engine 12 may have an alternate number of cylinders. For instance, the engine 12 may include two cylinders, three cylinders, six cylinders, etc., in other examples.

The intake system 16 includes an intake conduit 20 and a throttle 22 coupled to the intake conduit. The throttle 22 is configured to regulate the amount of airflow provided to the cylinder 18. In the depicted example, the intake conduit 20 feeds air to an intake manifold 24. The intake manifold 24 is coupled to and in fluidic communication with intake runners 26. The intake runners 26 in turn provide intake air to intake valves 28. In the illustrated example, two intake valves are depicted in FIG. 1. However, in other examples, the cylinder 18 may include a single intake valve or more than two intake valves. The intake manifold 24, intake runners 26, and intake valves 28 are included in the intake system 16.

The intake valves 28 may be actuated by intake valve actuators 30. Likewise, exhaust valves 32 coupled to the cylinder 18 may be actuated by exhaust valve actuators 34. In particular, each intake valve may be actuated by an associated intake valve actuator and each exhaust valve may be actuated by an associated exhaust valve actuator. In one example, the intake valve actuators 30 as well as the exhaust valve actuators 34 may employ cams coupled to intake and exhaust camshafts, respectively, to open/close the valves. Continuing with the cam driven valve actuator example, the intake and exhaust camshafts may be rotationally coupled to a crankshaft. Further in such an example, the valve actuators may utilize one or more of cam profile switching (CPS), variable cam timing (VCT), variable valve timing (VVT) and/or variable valve lift (VVL) systems to vary valve operation. Thus, cam timing devices may be used to vary the valve timing, if desired. It will therefore be appreciated, that valve overlap may occur in the engine, if desired. In another example, the intake and/or exhaust valve actuators, 30 and 34, may be controlled by electric valve actuation. For example, the valve actuators, 30 and 34, may be electronic valve actuators controlled via electronic actuation. In yet another example, cylinder 18 may alternatively include an exhaust valve controlled via electric valve actuation and an intake valve controlled via cam actuation including CPS and/or VCT systems. In still other embodiments, the intake and exhaust valves may be controlled by a common valve actuator or actuation system.

The fuel delivery system 14 provides pressurized fuel to a direct fuel injector 36. The fuel delivery system 14 includes a fuel tank 38 storing liquid fuel (e.g., gasoline, diesel, bio-diesel, alcohol (e.g., ethanol and/or methanol) and/or combinations thereof). The fuel delivery system 14 further includes a fuel pump 40 pressurizing fuel and generating fuel flow to a direct fuel injector 36. A fuel conduit 42 provides fluidic communication between the fuel pump 40 and the direct fuel injector 36. The direct fuel injector 36 is coupled (e.g., directly coupled) to the cylinder 18. The direct fuel injector 36 is configured to provide metered amounts fuel to the cylinder 18. The fuel delivery system 14 may include additional components, not shown in FIG. 1. For instance, the fuel delivery system 14 may include a second fuel pump. In such an example, the first fuel pump may be a lift pump and the second fuel pump may be a high-pressure pump, for instance. Additional fuel delivery system components may include check valves, return lines, etc., to enable fuel to be provided to the injector at desired pressures.

An ignition system 44 (e.g., distributorless ignition system) is also included in the engine 12. The ignition system 44 provides an ignition spark to cylinder via ignition device 46 (e.g., spark plug) in response to control signals from the controller 100. However, in other examples, the engine may be designed to implement compression ignition, and therefore the ignition system may be omitted, in such an example.

An exhaust system 48 configured to manage exhaust gas from the cylinder 18 is also included in the vehicle 10, depicted in FIG. 1. The exhaust system 48 includes the exhaust valves 32 coupled to the cylinder 18. In particular, two exhaust valves are shown in FIG. 1. However, engines with an alternate number of exhaust valves have been contemplated, such as an engine with a single exhaust valve, three exhaust valves, etc. The exhaust valves 32 are in fluidic communication with exhaust runners 50. The exhaust runners 50 are coupled to and in fluidic communication with an exhaust manifold 52. The exhaust manifold 52 is in turn coupled to an exhaust conduit 54. The exhaust runners 50, exhaust manifold 52, exhaust conduit 54, and muffler 200 are included in the exhaust system 48. The exhaust system 48 also includes an emission control device 56 coupled to the exhaust conduit 54. The emission control device 56 may include filters, catalysts, absorbers, etc., for reducing tailpipe emissions.

During engine operation, the cylinder 18 typically undergoes a four stroke cycle including an intake stroke, compression stroke, expansion stroke, and exhaust stroke. During the intake stroke, generally, the exhaust valves close and intake valves open. Air is introduced into the cylinder via the corresponding intake passage, and the cylinder piston moves to the bottom of the cylinder so as to increase the volume within the cylinder. The position at which the piston is near the bottom of the cylinder and at the end of its stroke (e.g., when the combustion chamber is at its largest volume) is typically referred to by those of skill in the art as bottom dead center (BDC). During the compression stroke, the intake valves and exhaust valves are closed. The piston moves toward the cylinder head so as to compress the air within combustion chamber. The point at which the piston is at the end of its stroke and closest to the cylinder head (e.g., when the combustion chamber is at its smallest volume) is typically referred to by those of skill in the art as top dead center (TDC). In a process herein referred to as injection, fuel is introduced into the cylinder. In a process herein referred to as ignition, the injected fuel in the combustion chamber is ignited via a spark from an ignition device (e.g., spark plug) and/or compression, in the case of a compression ignition engine. During the expansion stroke, the expanding gases push the piston back to BDC. A crankshaft converts this piston movement into a rotational torque of the rotary shaft. During the exhaust stroke, in a traditional design, exhaust valves are opened to release the residual combusted air-fuel mixture to the corresponding exhaust passages and the piston returns to TDC.

FIG. 1 also shows a controller 100 in the vehicle 10. Specifically, controller 100 is shown in FIG. 1 as a conventional microcomputer including: microprocessor unit 102, input/output ports 104, read-only memory 106, random access memory 108, keep alive memory 110, and a conventional data bus. Controller 100 is configured to receive various signals from sensors coupled to the engine 12. The sensors may include engine coolant temperature sensor 120, exhaust gas sensors 122, an intake airflow sensor 124, etc. Additionally, the controller 100 is also configured to receive throttle position (TP) from a throttle position sensor 112 coupled to a pedal 114 actuated by an operator 116.

Furthermore, the controller 100 may be configured to trigger one or more actuators and/or send commands to components. For instance, the controller 100 may trigger adjustment of the throttle 22, intake valve actuators 30, exhaust valve actuators 34, ignition system 44, and/or fuel delivery system 14. Specifically, the controller 100 may be configured to send signals to the ignition device 46 and/or direct fuel injector 36 to adjust operation of the spark and/or fuel delivered to the cylinder 18. Therefore, the controller 100 receives signals from the various sensors and employs the various actuators to adjust engine operation based on the received signals and instructions stored in memory of the controller. Thus, it will be appreciated that the controller 100 may send and receive signals from the fuel delivery system 14.

For example, adjusting the direct fuel injector 36 may include adjusting a fuel injector actuator to adjust the direct fuel injector. In yet another example, the amount of fuel to be delivered via the direct fuel injector 36 may be empirically determined and stored in predetermined lookup tables or functions. For example, one table may correspond to determining direct injection amounts. The tables may be indexed to engine operating conditions, such as engine speed and engine load, among other engine operating conditions. Furthermore, the tables may output an amount of fuel to inject via direct fuel injector to the cylinder at each cylinder cycle. Moreover, commanding the direct fuel injector to inject fuel may include at the controller generating a pulse width signal and sending the pulse width signal to the direct fuel injector.

Figure 2:
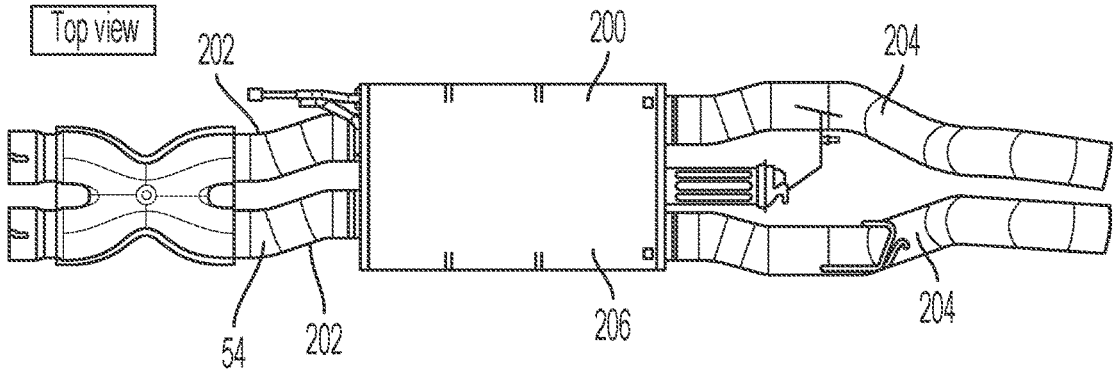
FIG. 2 is a top view of the multi-mode exhaust muffler in FIG. 1 showing a possible orientation of inlet and exhaust pipes forming a dual exhaust system.
Figure 3:
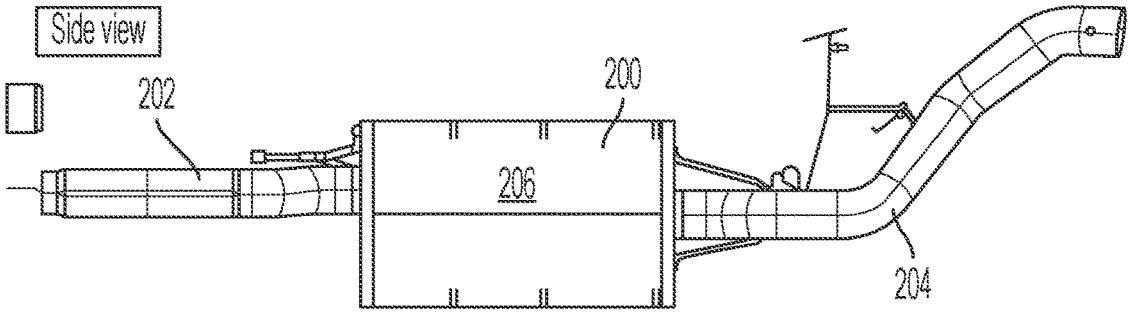
FIG. 3 is a side view of the multi-mode exhaust muffler of FIG. 2.

FIG. 2 shows a top view of an exhaust system 48 with the multi-mode muffler 200 in accordance with an embodiment of the present invention. FIG. 3 shows the side view thereof. The exhaust system 48 includes inlet pipes 202 and exhaust pipes 204 operably secured to the muffler 200. Exhaust gasses pass through the inlet pipes 202 through the muffler 200 to the exhaust pipes 204 where the exhaust gases are then released to the environment.

Figure 4:
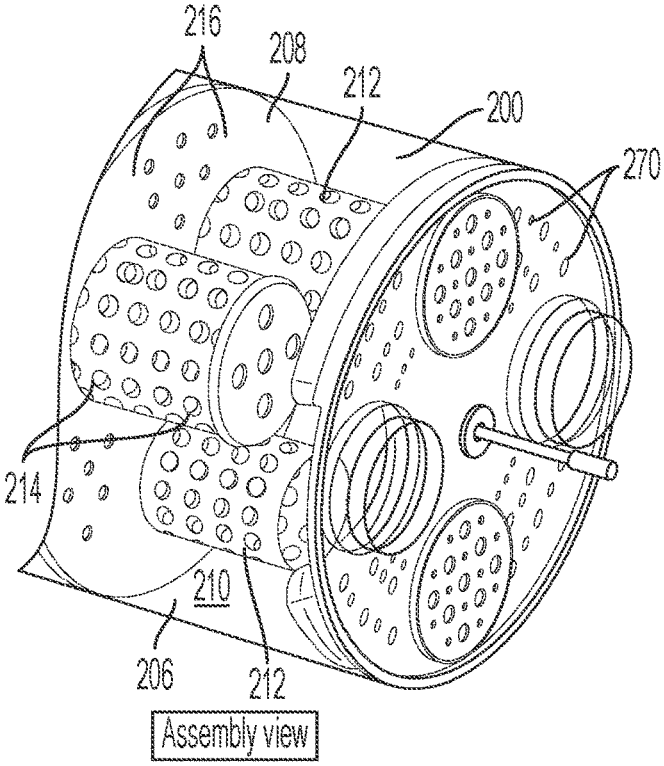
FIG. 4 is a partial isometric view of a portion of the multi-mode exhaust muffler of FIG. 2.

FIG. 4 shows the muffler 200 of FIG. 2 with an exterior frame 206 shown transparent to show internal detail. The muffler 200 includes a plurality of spaced apart plates 208 defining chambers 210 therein with a plurality of internal tubes 212 extending therethrough. The internal tubes 212 may include a plurality of spaced apart perforations 214 thereby allowing exhaust gas to enter various chambers 210 within the system. Holes 216 in the plates 208 also allow exhaust gas to travel between the chambers 210. It can be appreciated that the diameter, length, number and position of the internal tubes and holes can be optimized so as to tune the muffler to a desired noise attenuation.

Figure 6:
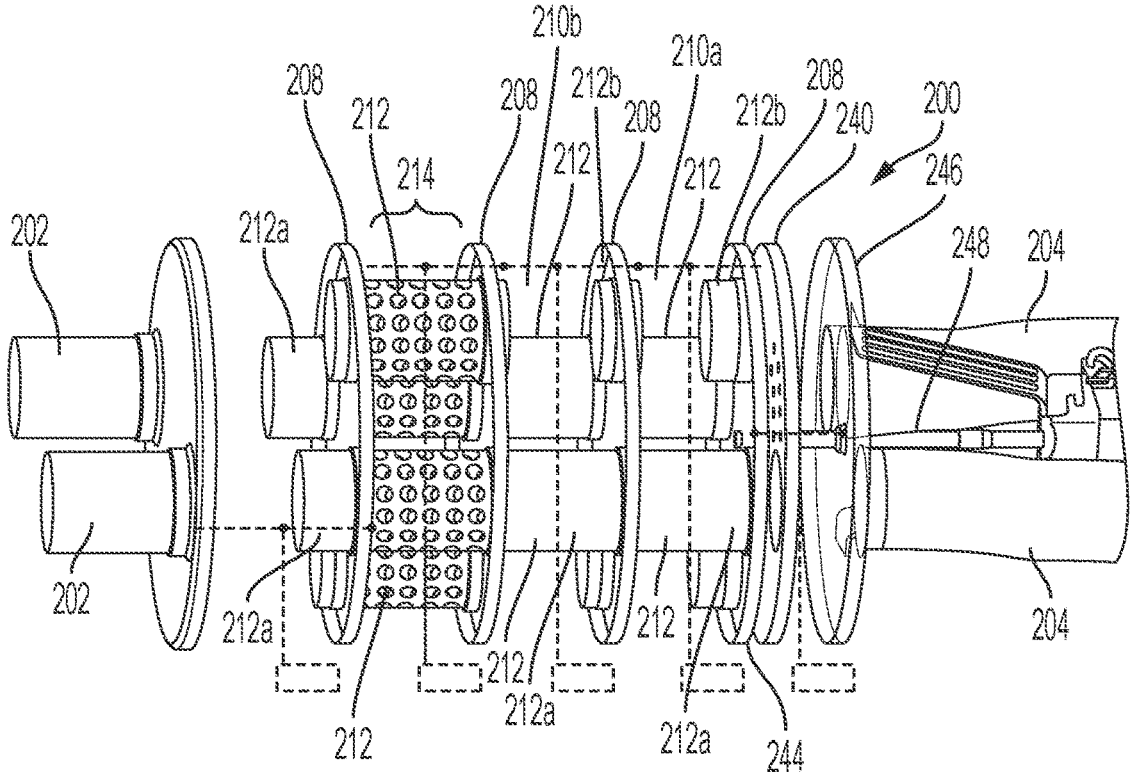
FIG. 6 is a partial, exploded isometric view of the multi-mode exhaust muffler of FIG. 2 with the external case removed to show possible internal detail.

As best shown in FIG. 6, the internal tubes 212 can be positioned and sized so as to provide two different exhaust gas flow paths through the muffler. For example, exhaust gas passing through internal tubes 212*a* pass completely through chambers 210*a* and 210*b* without existing the internal tubes 212*a*. Alternatively, exhaust gas passing through tubes 212*b* must also pass through chambers 210*a* and 210*b*. These different flow paths provide different noise attenuation characteristics and structures along each flow path, and they can be independently tuned to provide a desired noise attenuation characteristic for each flow path.

Figure 5:
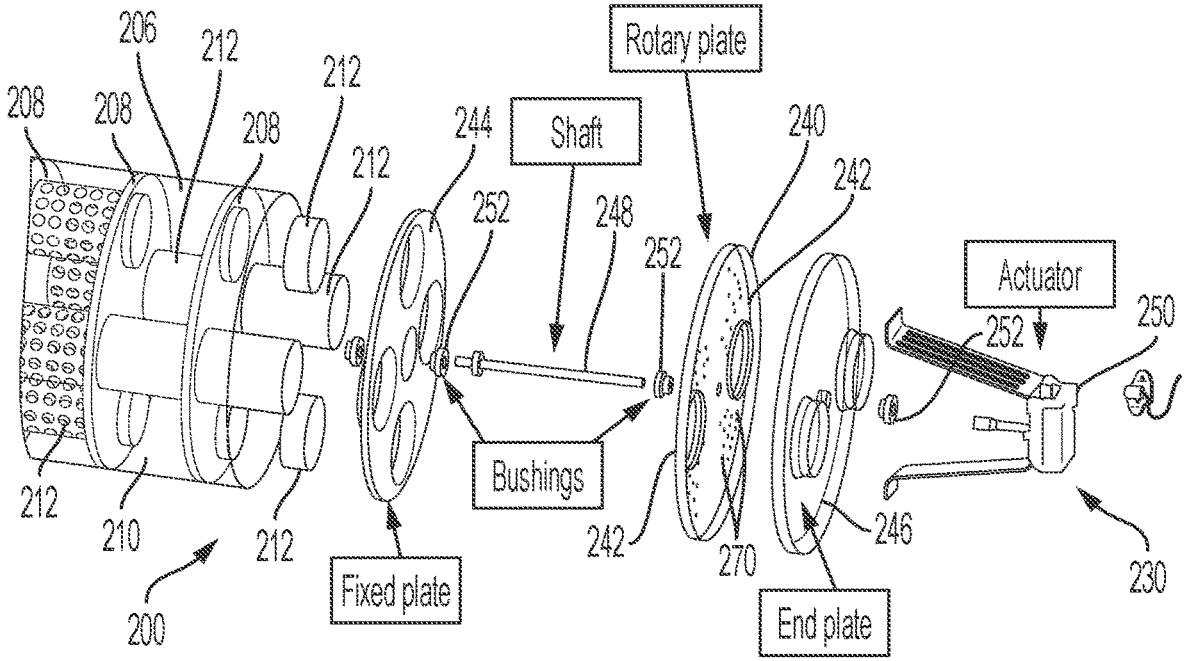
FIG. 5 is a partial, exploded isometric view of the multi-mode exhaust muffler of FIG. 2

As best shown in FIGS. 5 & 6, one end of the muffler may include an internal mechanism 230 that varies the geometry of apertures relative to sound attenuation devices to connect the different exhaust gas flow paths between the inlet tubes 202 and exhaust tubes 204. This allows the muffler to provide more than one possible sound profile.

Referring to FIG. 5, one known internal mechanism 230 includes providing a rotary plate 240 having spaced apart openings 242 therethrough and positioned between a fixed plate 244 and an exhaust plate 246. The rotating plate 240 is pivotally secured to a shaft 248 that is operably secured to an actuator 250. Bushings 252 are operably secured between the plates and shaft to facilitate operation The actuator turns the plate along the shaft axis to align different apertures on the plate with opening in the fixed place to thereby connect one of the possible two different flow paths previously described through the muffler.

Figure 7:
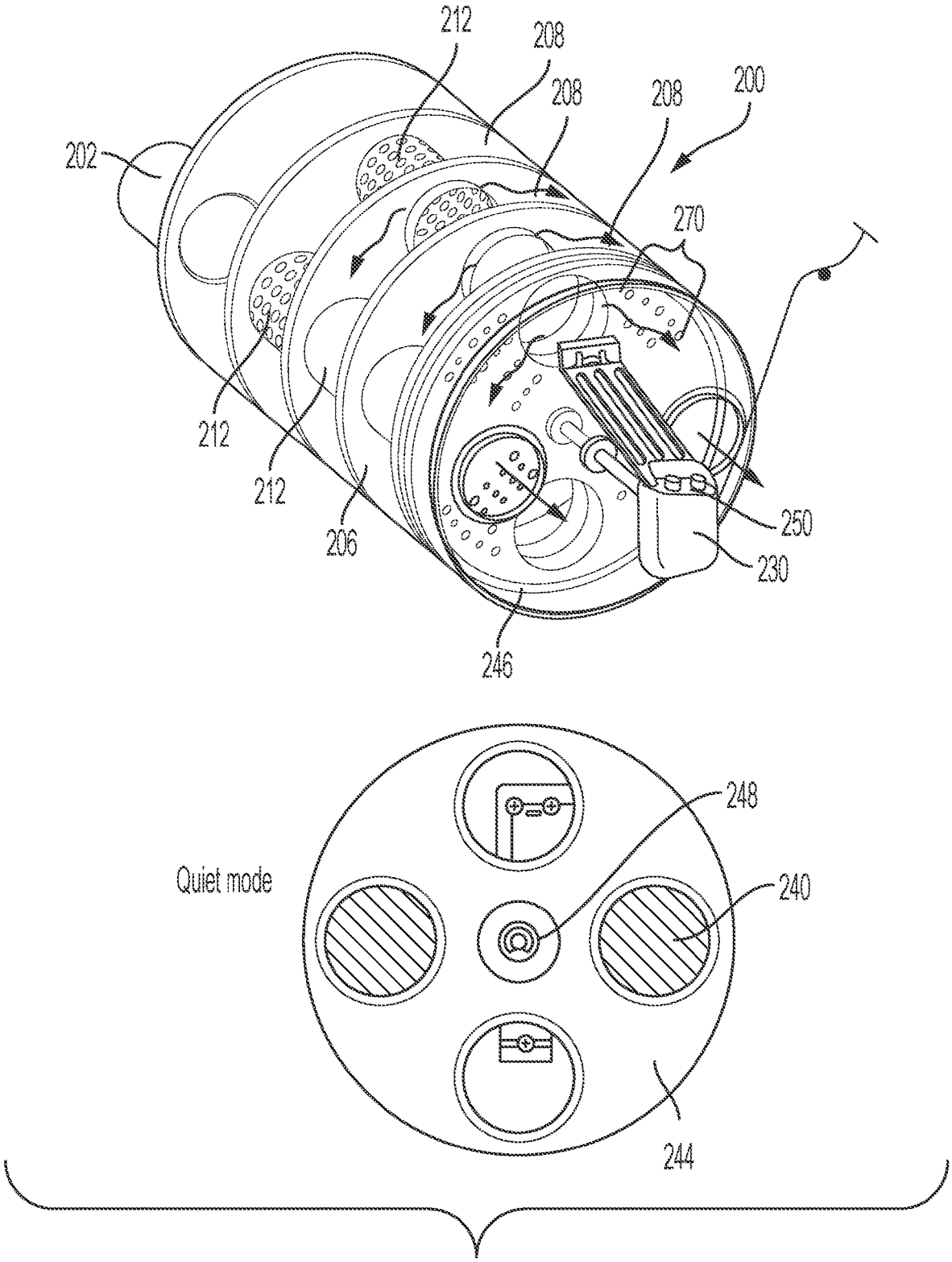
FIG. 7 is a partial, isometric view of the multi-mode exhaust muffler of FIG. 2 showing a possible orientation of the rotary plate that provides an exhaust gas flow path to define a possible "quiet mode" of operation.
Figure 8:
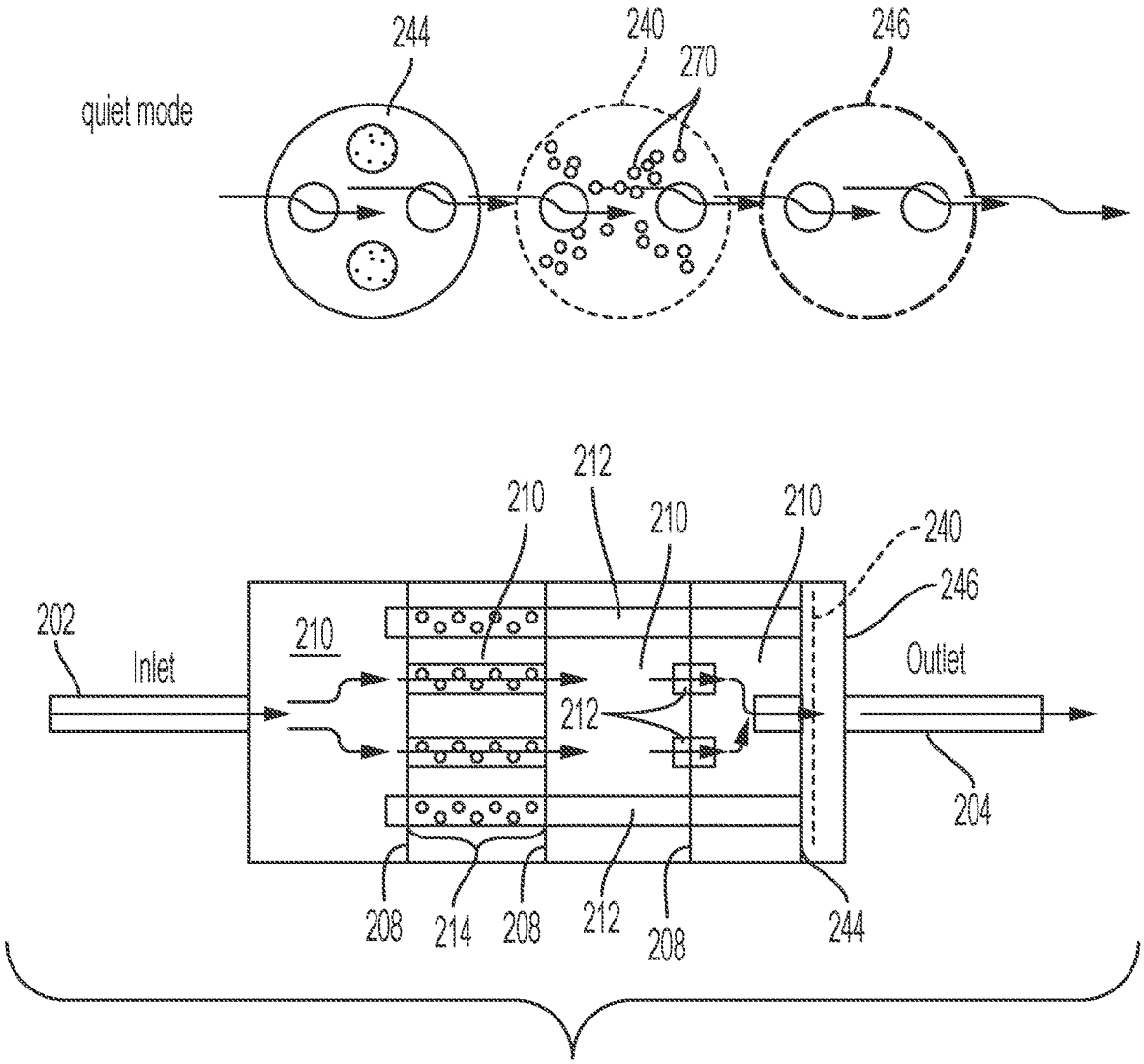
FIG. 8 is a schematic view of the multi-mode exhaust muffler of FIG. 2 showing the position of the rotary plate relative to the fixed plate and a possible resulting exhaust gas flow path through the muffler while in "quiet mode."
Figure 9:
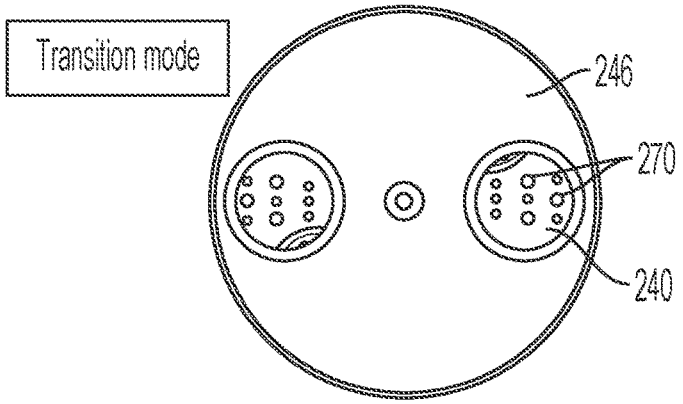
FIG. 9 is a schematic view of the multi-mode exhaust muffler of FIG. 2 showing a possible orientation of the rotary plate that provides an exhaust gas flow path to define a possible "transition mode."

For example, and as shown in FIGS. 7 and 8, a first position of the rotating plate relative to the fixed plate may fluidly connect the inlet tube 202 to the exhaust tube 204 through a first flow path that is optimized to provide maximum sound reduction. This configuration may be referred to as "quiet mode."

Figure 11:
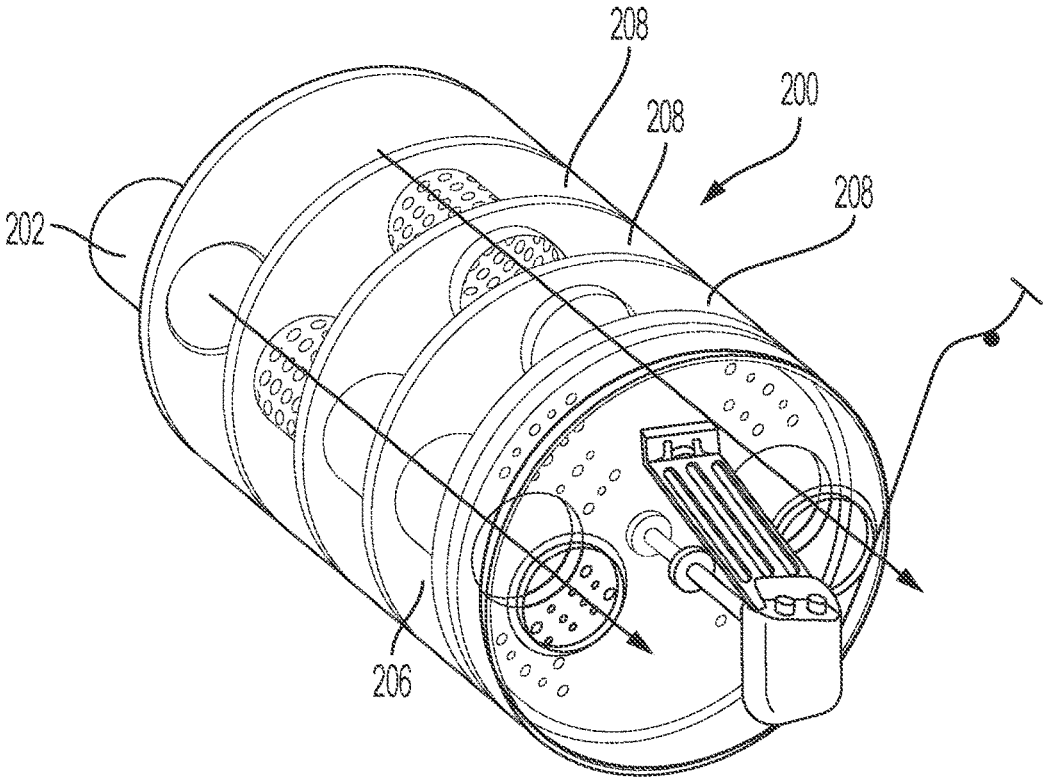
FIG. 11 is a partial, isometric view of the multi-mode exhaust muffler of FIG. 2 showing a possible orientation of the rotary plate that provides an exhaust gas flow path to define a possible "loud mode" of operation.
Figure 11:
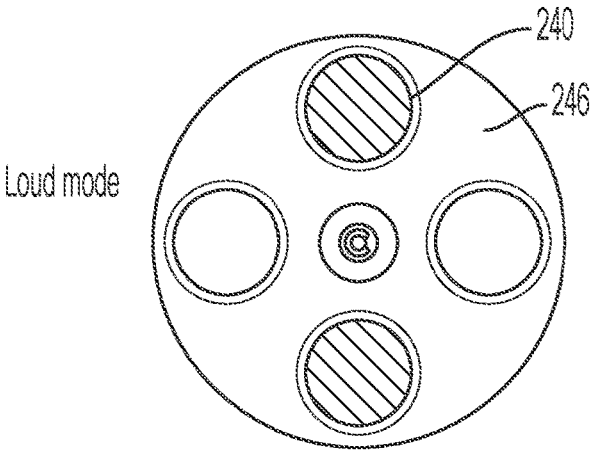
Figure 12:
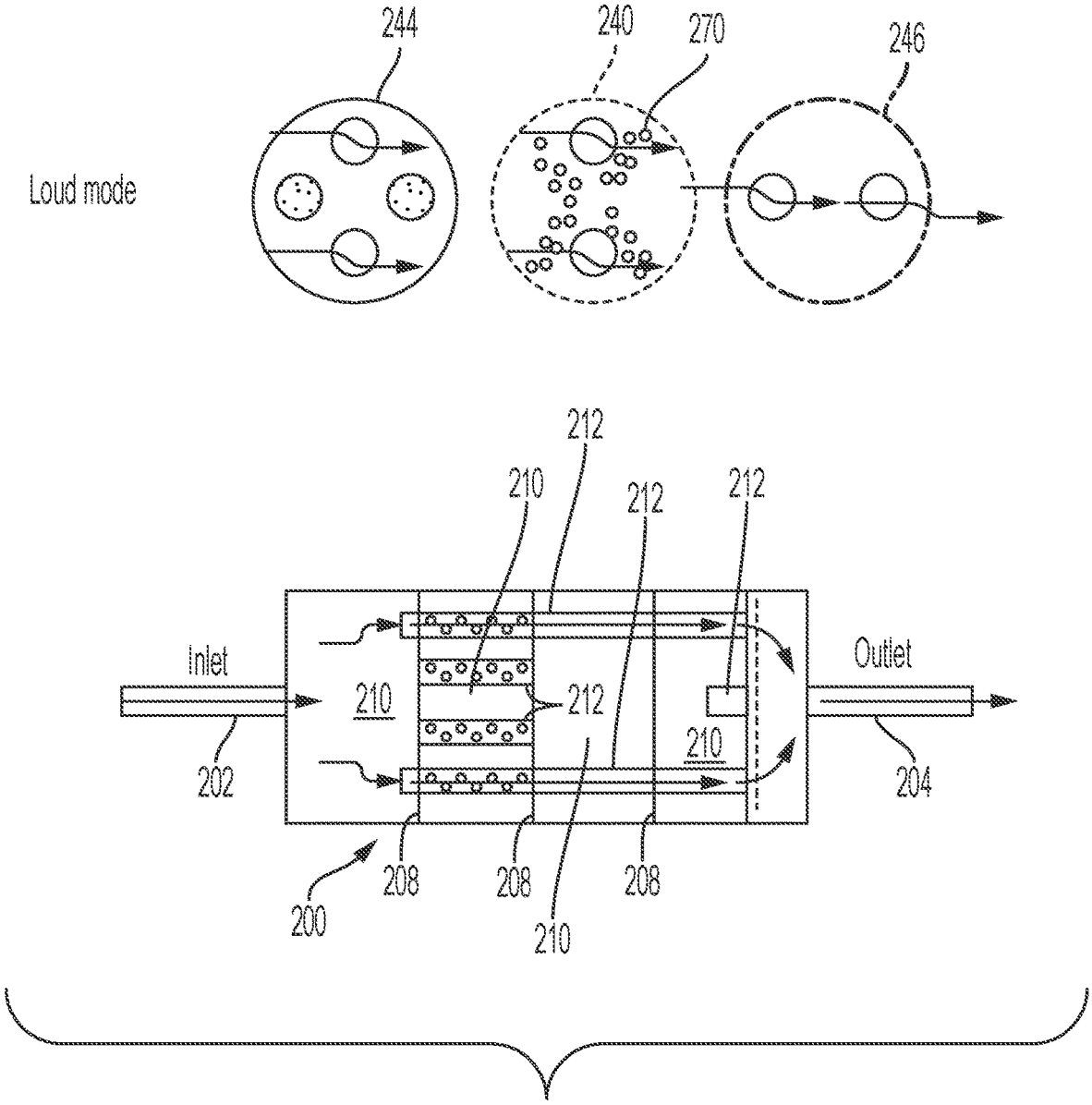
FIG. 12 is a schematic view of the multi-mode exhaust muffler of FIG. 2 showing the position of the rotary plate relative to the fixed plate and a possible resulting exhaust gas flow path through the muffler while in "loud mode."

Alternatively, and as best shown in FIGS. 11 and 12, the rotary plate 240 can be rotated relative to the fixed plate 244 to fluidly connect the inlet tubes 202 to the exhaust tubes 204 through a second flow path that is selected to not provide maximum sound reduction. This configuration may be referred to as "loud mode."

Figure 10:
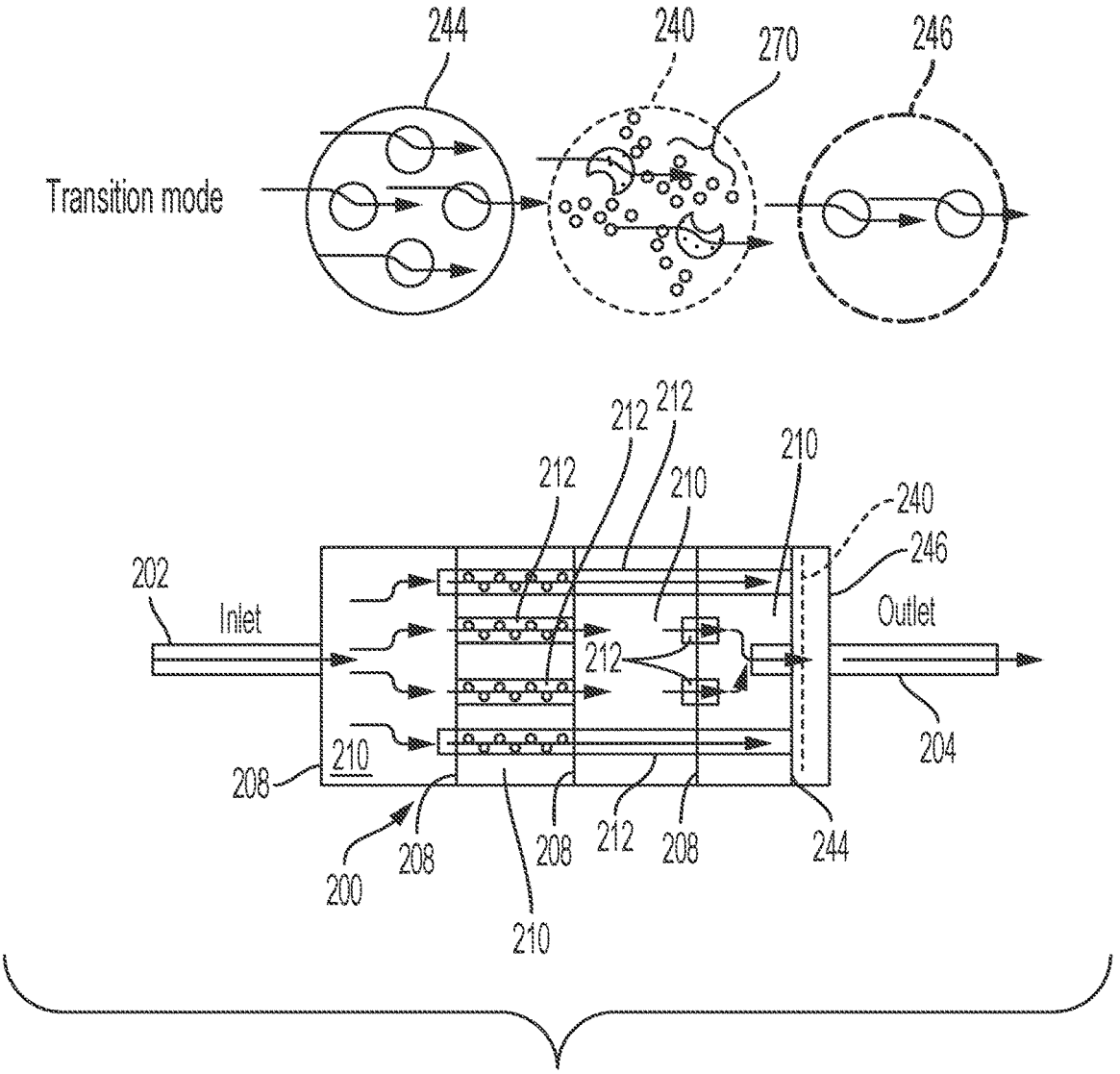
FIG. 10 is a schematic view of the multi-mode exhaust muffler of FIG. 2 showing the position of the rotary plate relative to the fixed plate and a possible resulting exhaust gas flow path through the muffler while in "transition mode."

It can be appreciated that when rotating the rotary plate 240 between the first and second positions, the opening in the rotary plate 240 and fixed plate 244 can allow exhaust gas to flow through both the first and second flow paths as shown in FIG. 10. This flow configuration may be referred to as "transition mode" and may provide desirable noise qualities as well. Smaller holes 270 provided in the rotary plate facilitate exhaust gas flow through the rotary plate 240 while in transition mode.

The actuator 250 can be an electrical, vacuum or solenoid actuator. As shown in FIG. 1 the actuator can be in electrical communication with the controller 100 and be manually activated or activated as desired based on predetermined criteria. For example, a noise sensor may be operably connected to the controller 100 and the actuator can be activated to rotate the rotary disk as desired based on detected noise levels.

Figure 13:
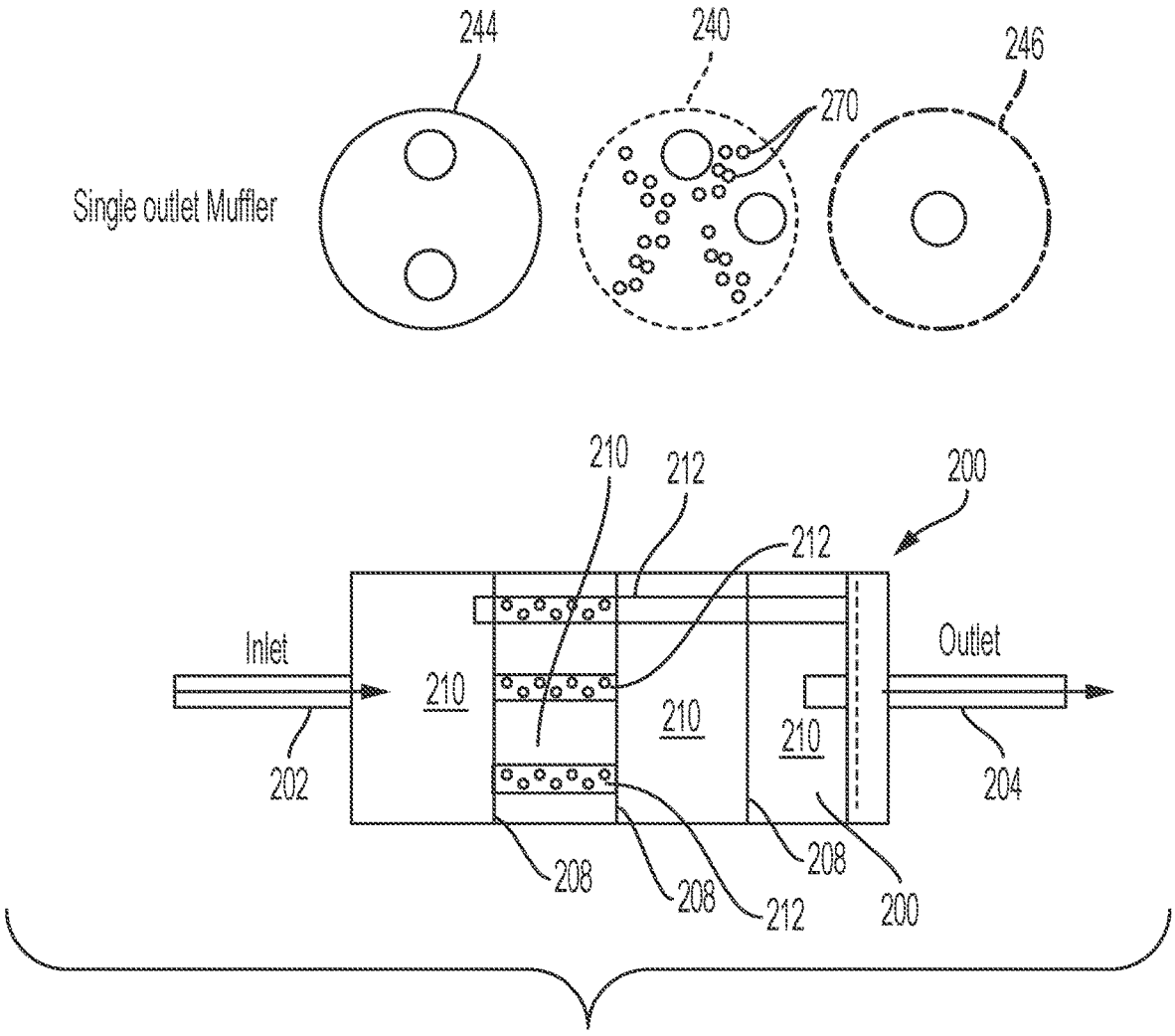
FIG. 13 is a schematic view of an alternative possible embodiment of the multi-mode exhaust muffler of FIG. 2 showing a possible single outlet.

Referring to FIG. 13, it can be appreciated that the structures and rotary plate 240 can be easily adapted to work equally well with a single outlet muffler 200' as shown.

Figure 14:
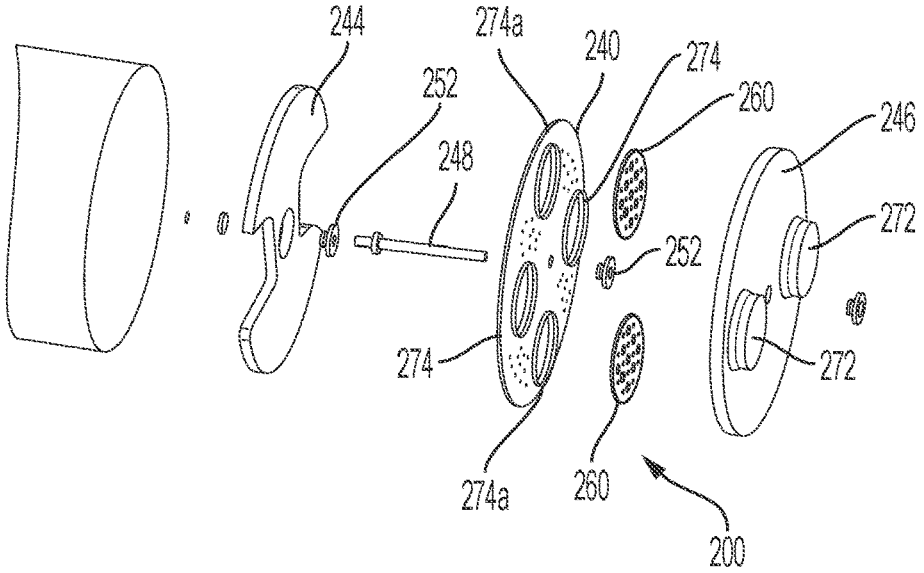
FIG. 14 is an exploded view of an alternative possible rotating disk structure of the multi-mode exhaust muffler in accordance with an embodiment of the present invention.
Figure 14:
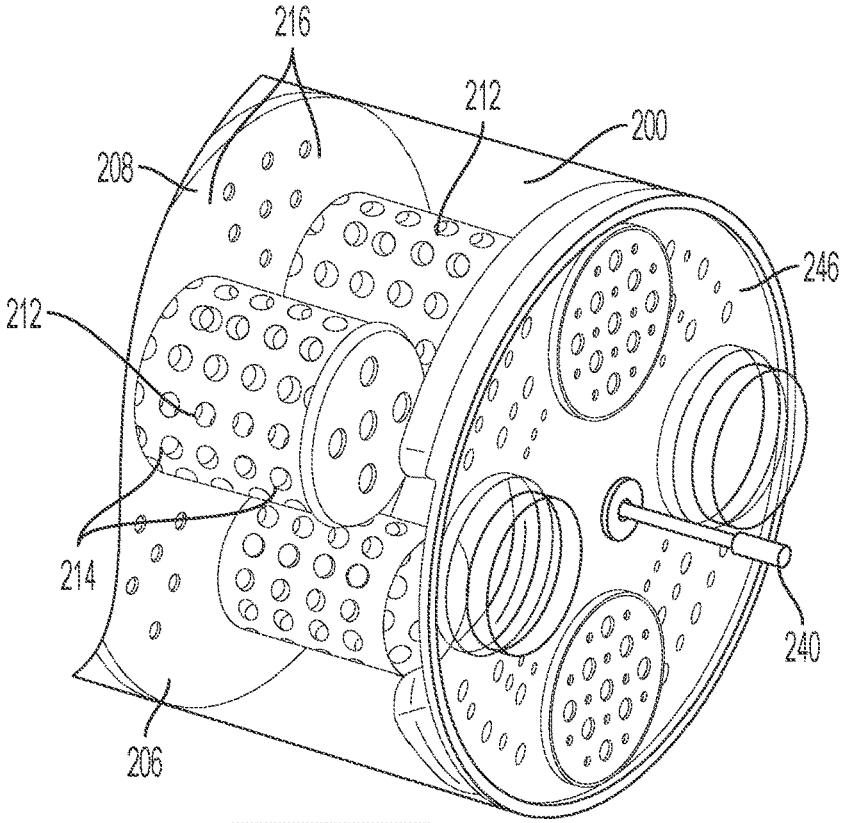
Figure 15:
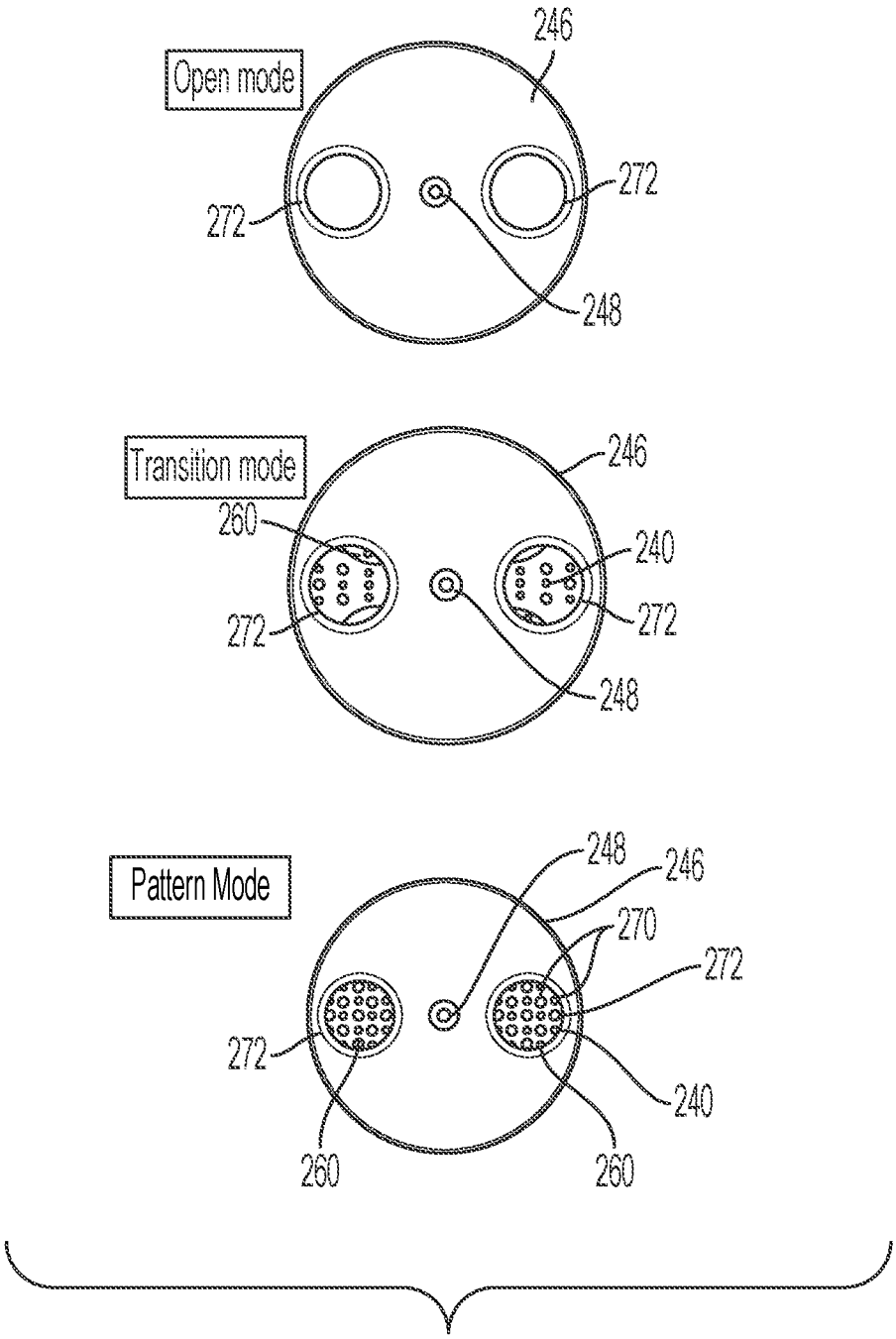
FIG. 15 is a back view of the rotating disk relative to an exhaust plate showing possible orientation of the rotating disk relative to the exhaust plate in accordance with the embodiment of FIG. 14.

FIGS. 14 and 15 show an alternative possible rotary plate 240 hole configuration in combination with only one flow path through the muffler 200. The location of the holes 274 in the rotary plate 240 relative to the holes 272 in the exhaust plate 246 regulate exhaust gas flow through the muffler thereby providing variable noise attenuation. Moreover, porous inserts 260 may be provided in select rotary plate 240 holes 274*a*. The rotating disk may be positioned relative to the exhaust plate to allow fully unrestricted flow through the exhaust plate holes as shown as "open mode" in FIG. 15. Alternatively, a portion of the small holes in the rotating plate may be positioned over the exhaust plate holes as shown in "transition mode" in FIG. 15. "Pattern Mode" in FIG. 15 shows the porous inserts 260 fully covering he rotating plate thereby providing the least restrictive exhaust gas flow through the muffler.

FIGS. 1-15 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, elements shown contiguous or adjacent to one another may be contiguous or adjacent to each other, respectively, at least in one example. For example, laying in face-sharing contact with each other may be referred to as in face-sharing contact. As another example, elements positioned apart from each other with only a space there-between and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

It will be appreciated that the configurations and routines disclosed herein are exemplary in nature, and that these specific embodiments are not to be considered in a limiting sense, because numerous variations are possible. For example, the above technology can be applied to V-6, 1-4, 1-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A muffler for attenuating exhaust gas noise comprising:

a housing connectable to an exhaust gas inlet and an exhaust gas outlet;

a first exhaust gas flow path from said exhaust gas inlet, through said housing, to said exhaust gas outlet, said first exhaust gas flow path having a first defined noise attenuating profile;

a second exhaust gas flow path from said first exhaust inlet, through said housing, to said exhaust gas outlet, said second exhaust gas flow path having a second defined noise attenuating profile; and a plurality of plates defining chambers within the housing, wherein the plates comprise a fixed plate, a rotary plate for regulating a flow of exhaust gas through said first exhaust gas flow path and said second exhaust gas flow path, and an end plate, wherein the rotary plate is operably secured between the fixed plate and the end plate via a shaft extending through each of the plates and the end plate is at least partially within the housing.

2. The muffler for attenuating exhaust gas noise of claim 1, wherein the rotary plate has a first position that directs exhaust gas to the first exhaust gas flow path and a second position that directs exhaust gas to the second exhaust gas flow path.

3. The muffler for attenuating exhaust gas noise of claim 2, wherein the first defined noise attenuating profile is quieter than the second defined noise attenuating profile, thereby defining a quiet mode when the rotary plate is in said first position and a loud mode when the rotary plate is in said second position.

4. The muffler for attenuating exhaust gas noise of claim 2, further including the rotary plate having a third position that directs exhaust gas though both the first and second exhaust gas flows.

5. The muffler for attenuating exhaust gas noise of claim 4, wherein the first defined noise attenuating profile is quieter than the second defined noise attenuating profile, thereby defining a quiet mode when the rotary plate is in said first position, a loud mode when the rotary plate is in said second position, and a transition mode when said rotating plate is in said third position.

6. The muffler for attenuating exhaust gas noise of claim 1, wherein the rotary plate is driven by the shaft, wherein the shaft is coupled to an external actuator.

7. The muffler for attenuating exhaust gas noise of claim 6, wherein the external actuator is selected from the group consisting of electric-activation, pneumatic-activation, vacuum-activation and solenoid-activation.

8. The muffler for attenuating exhaust gas noise of claim 6, wherein the external actuator is manually activated.

9. The muffler for attenuating exhaust gas noise of claim 6, wherein the actuator is in communication with a computer system and a sensor and the actuator activates in response to a predetermined criteria based on information obtained by the sensor.

10. The muffler for attenuating exhaust gas noise of claim 1, wherein the rotary plate has at least one hole therethrough and is positioned within the first and second exhaust gas flow paths to align said at least one hole with one of said first and second exhaust gas flow paths.

11. An exhaust system for an internal combustion engine comprising:

an exhaust gas inlet tube extending from the internal combustion engine;

a muffler operably connected to the inlet tube, the muffler having a housing and defining a first exhaust gas flow path and a second exhaust gas flow path therethrough, said first exhaust gas flow path having a first defined noise attenuating profile, and said second exhaust gas flow path having a second defined noise attenuating profile, wherein each exhaust gas flow path comprises a tube comprising a plurality of spaced apart perforations;

a rotary plate operably secured to the muffler for regulating the flow of exhaust gas through said first exhaust gas flow path and said second exhaust gas flow path; and an exhaust tube extending from said muffler.

12. The exhaust system for an internal combustion engine of claim 10, wherein the rotary plate has a first position that directs exhaust gas to the first exhaust gas flow and a second position that directs exhaust gas to the second exhaust gas flow.

13. The exhaust system for an internal combustion engine of claim 12, wherein the first defined noise attenuating profile is quieter than the second defined noise attenuating profile, thereby defining a quiet mode when the rotary plate is in said first position and a loud mode when the rotary plate is in said second position.

14. The exhaust system for an internal combustion engine of claim 13, further including the rotary plate having a third position that directs exhaust gas though both the first and second exhaust gas flows.

15. The exhaust system for an internal combustion engine of claim 10, wherein the rotary plate has at least one hole therethrough and is positioned within the first and second exhaust gas flow paths to align said at least one hole with one of said first and second exhaust gas flow paths.

16. The exhaust system for an internal combustion engine of claim 10, wherein the rotary plate is driven by a shaft coupled to an external actuator.

17. A method for controlling noise dampening characteristics of a muffler using a rotary plate in pneumatic communication with a first and second exhaust gas flow paths within the muffler comprising:

adjusting the rotary plate to a first position relative to a fixed plate to allow exhaust gas to pass through the first exhaust gas flow path; and adjusting the rotary plate to a second position relative to the fixed plate to allow exhaust gas to pass through the second exhaust gas flow path, wherein the rotary plate is operably secured between the fixed plate and an end plate via a shaft extending through each of the plates; and wherein the fixed plate, rotary plate and end plate are spaced apart, wherein the exhaust gas inlet and the exhaust gas outlet are on opposite ends of the housing.

18. The method for controlling the noise dampening characteristics of the muffler of claim 17, further including the step of adjusting the rotary plate to a third position to allow exhaust gas to pass through both the first and second exhaust gas flow paths.

19. The method for controlling noise dampening characteristics of the muffler of claim 17, further including the step of tuning the muffler to be quieter when exhaust gas passes through the first exhaust gas flow path than when the exhaust gas passes through the second exhaust gas flow path.

* * * * *